United States Patent [19]

Pikorz et al.

[11] Patent Number: 4,464,441

[45] Date of Patent: Aug. 7, 1984

[54] MOLYBDENUM COATED WITH A NOBLE METAL

[75] Inventors: Wolfgang Pikorz; Hans Scheuermann; Alois Sonntag, all of Warstein, Fed. Rep. of Germany

[73] Assignee: Licentia Patent-Verwaltungs-GmbH, Frankfurt am Main, Fed. Rep. of Germany

[21] Appl. No.: 313,661

[22] Filed: Oct. 21, 1981

[30] Foreign Application Priority Data

Oct. 21, 1980 [DE] Fed. Rep. of Germany ..... 3039658

[51] Int. Cl.[3] ..... B32B 15/01

[52] U.S. Cl. ..... 428/579; 428/664; 428/666; 428/670; 428/672; 428/673; 428/926

[58] Field of Search ..... 428/664, 666, 670, 672, 428/673, 926, 579–581; 357/71, 67

[56] References Cited

U.S. PATENT DOCUMENTS

| | | | |
|---|---|---|---|
| 2,697,130 | 12/1954 | Korbelak | 428/666 |
| 2,886,499 | 5/1959 | Schafer et al. | 428/666 |
| 2,928,169 | 3/1960 | Beach et al. | 428/666 |
| 3,319,134 | 5/1967 | Csakvary | 357/67 |
| 3,633,076 | 1/1972 | Arndt et al. | 357/71 |
| 3,840,398 | 10/1974 | Sonntag | 357/71 |

OTHER PUBLICATIONS

Herstellung extrem haftfester Goldniederschlage auf Molybdan, das im Hochvakuum Lufteinbruchen und Wechselnd hohen Temperaturen (450 . . . 900° C.) ausgesetzt ist", Metalloberflache, vol. 24, 1970, p. 299.

"Edemetall-Gavanotechnik" by A. von Krusenstjern, 1970, pp. 125 and 254 and 256.

Thomas, J. et al.; "Diode Sheds Its Costly Package with Beam-Lead Construction" *Electronics* pp. 77–81, (12/24/66).

*Primary Examiner*—Michael L. Lewis

*Attorney, Agent, or Firm*—Spencer & Frank

[57] ABSTRACT

A molybdenum disc suitable for the use as a semiconductor. The disc has a thickness of about 0.5 to several mm and is coated with a noble metal that is applied to the molybdenum in a layer thickness of 0.02μ via an intermediate layer of chromium having a layer thickness of 0.5 to 10.0μ.

3 Claims, No Drawings

MOLYBDENUM COATED WITH A NOBLE METAL

BACKGROUND OF THE INVENTION

The present invention relates to molybdenum which is coated with a noble metal and to a method for producing such a layer sequence.

Such layer sequences are frequently used in the semiconductor art as contact materials because the coefficient of thermal expansion of the silicon used as the semiconductor material and the coefficient of thermal expansion of the molybdenum used as the contact material are very similar to one another and thus produce no, or only slight, thermal stresses under changing operating temperatures. Customarily the molybdenum which is used, for example, in the form of discs having a disc thickness of about 0.5 to several mm, is coated with a noble metal which produces a favorable electrical contact resistance. On the other hand, the noble metal protects the molybdenum contact against surface oxidation and the attack of aggressive chemicals which act on the semiconductor body in the course of further process steps incorporating etching treatments. Such chemicals are required to shape the semiconductor body and give it its particular properties, but most not damage the molybdenum contact during such etching treatments.

Due to the high price of noble metals, it is desirable to have the coating as thin as possible, but a certain minimum thickness of the noble metal must be provided because otherwise sufficient etching resistance is no longer assured. For example, with gold as the coating material, a satisfactory etching resistance is achieved only if the layer thickness is at least 1.5 to 3$\mu$. With a layer thickness less than 1.5$\mu$, pores develop through which the attack of the molybdenum base material during etching cannot be avoided. For that reason, it has previously been necessary in practice to provide a thicker gold layer. Additionally, thinner layer thicknesses for the coating material result in higher costs for the base material because it must be prepared better and more uniformly.

Moreover, the high mechanical sensitivity of such noble metal thin layers is a drawback. If, for example, circular discs are to be cut from the gold-coated molybdenum sheets, which is advisable and the general custom, this mechanical sensitivity requires noble metal layer thicknesses of about 5$\mu$. With small disc diameters, for example, diameters of about 6 mm, the noble metal layers must be up to 10$\mu$ thick.

Experiments have been made to replace noble metals, such as gold, by other more economically priced metals. However, almost all non-noble metals have a much too low etching resistance and are unsuitable already for this reason. The only suitable non-noble metal seems to be chromium which is vapor-deposited or applied electrochemically and exhibits good adhesion as well as good etching resistance.

However, the drawback of a chromium coating is that it produces poor and, most importantly, fluctuating transfer resistances which preclude general application. These fluctuating transfer resistances of chromium are probably caused by oxidation processes at the surface which occur randomly and irregularly and cannot be influenced directly. In the course of the manufacture of a semiconductor component for which molybdenum discs are used, several process steps involve temperatures of more than 100° C. which obviously enhances the above-mentioned oxidation processes. These process steps which involve temperatures of more than 100° C. occur from the time the diffused silicon body is alloyed onto the molybdenum disc, which is coated with chromium on one side, until the assembly is installed in a hermetically sealed housing.

The poor fluctuating transfer resistances are observed mainly when the chromium is deposited electrochemically, but can also not be avoided if the chromium is vapor deposited. Additionally, coating by way of vapor deposition requires a complicated and much more expensive procedure. The advantage of chromium, which is less expensive than the noble metal, is more than cancelled out of by the uneconomical coating process. For the above reasons, chromium has also failed to find acceptance in practice as a coating material and is unable to replace the conventional thicker noble metal layers.

SUMMARY OF THE PRESENT INVENTION

It is an object of the present invention to provide a coated molybdenum product in which their is a reduction in the large amount of noble metal previously used for the coating of molybdenum, but which retains the favorable transfer resistance, the good adhesion and the other known advantages of noble metals.

A further object of the present invention is to avoid the above-mentioned drawbacks of other substances and processes, such as poor etching resistance, higher expenditures in the preparation of the base material, mechanical sensitivity, fluctuating transfer resistances or lack of cost effectiveness.

Another object of the present invention is to provide a novel process for producing a molybdenum coated product.

Additional objects and advantages of the present invention will be set forth in part in the description which follows and in part will be obvious from the description or can be learned by practice of the invention. The objects and advantages are achieved by means of the processes, instrumentalities and combinations particularly pointed out in the appended claims.

To achieve the foregoing objects and in accordance with its purpose, the present invention provides molybdenum which is coated with a noble metal, with the noble metal being applied to the molybdenum in a layer thickness of 0.02 to 1.0$\mu$, via an intermediate layer of chromium having a layer thickness of 0.5 to 10.0$\mu$. The noble metal layer thickness preferably is 0.1$\mu$ and the chromium layer thickness is 1.5$\mu$.

The present invention makes it possible to reduce the requirement for noble metal to an amount which is less, by almost two orders of magnitude, than used in the past, and as a result the proportion of the cost of the noble metal compared to the entire process is now of a subordinate significance. At the same time, in spite of the reduced proportion of noble metal, the layer sequence has an excellent etching resistance to known etching solution mixtures of nitric acid, hydrofluoric acid, acetic acid and possibly ortho-phosphoric ($H_3PO_4$) acid and exhibits surprisingly good and uniform transfer resistances. A further advantage of the chromium-gold layer sequence, compared to pure noble metal coatings, for example gold coatings, is that the sequence of the present invention has better wear resistance. Moreover, the manufacture of the layer sequence, which is described in detail below, simultaneously utilizes the known advantages of electrochemical processes and avoids the expensive vapor-deposition processes, so that the use of the layer sequence according to the present invention is extremely economical and is suitable for noble metals, such as gold, silver platinum, palladium, rhodium and ruthenium.

It can be assumed that the excellent properties of the layer sequence according to the present invention are based on a diffusion of the noble metal into the chromium surface, which is thus stabilized against undesirable oxidation processes. A reduction of the electron work functions also correspondingly reduces the transfer resistance.

Another part of the present invention relates to a process with which the layer sequence of molybdenum, chromium in contact with the molybdenum and noble metal in contact with the chromium is produced in an advantageous manner. This process is performed by the sequence of the process steps listed below, some of which are known:

(a) preliminarily degreasing the molybdenum in an organic solvent;
(b) rinsing the molybdenum in water;
(c) purification etching the molybdenum;
(d) rinsing the molybdenum in water;
(e) repeating the purification etching according to step (c);
(f) rinsing the molybdenum in water;
(g) treating the rinsed molybdenum in an alkali degreasing bath;
(h) rinsing the molybdenum in water;
(i) activating the molybdenum surface;
(j) electrochemically applying a layer of the chromium to the molybdenum;
(k) rinsing the molybdenum and applied chromium layer in water;
(l) cathodically activating the chromium layer;
(m) rinsing the molybdenum and activated chromium layer in water;
(n) electrochemically applying a layer of noble metal to the chromium layer to form a layered product;
(o) rinsing the layered product in water; and
(p) tempering the applied layers in a protective gas such as hydrogen.

DESCRIPTION OF THE PREFERRED EMBODIMENTS

It has been found to be advantageous to perform process step (c) in a solution of 1 part by volume of concentrated sulfuric acid, 1 part by volume of concentrated nitric acid and 3 parts by volume of concentrated ortho-phosphoric ($H_3PO_4$) acid at room temperature for a period of 15 seconds. Further, it is preferable to perform process step (g) at a current density of about 20 A/dm$^2$ at room temperature for a period of 30 seconds. It is likewise advisable in process step (i) to activate the molybdenum surface in concentrated hydrocholoric acid at room temperature for a period of about 15 seconds.

It is preferred to coat the molybdenum with chromium according to step (j) in a bath comprising 400 g $CrO_3$ and 4 g $H_2SO_4$ per liter with a current density of 15 A/dm$^2$ at a temperature of 50±5° C. for a period of 8 minutes. The cathodic activation of the chromium layer according to step (l) is advantageously achieved in 1 to 15% sulfuric acid, preferably 8% sulfuric acid, at a current density of 2 to 40 A/dm$^2$, preferably 20 A/dm$^2$, at room temperature for a period of 2 to 60 seconds, preferably 20 seconds.

The coating of step (n) can be a coating to apply a layer of gold, silver, platinum, palladium, rhodium or ruthenium.

When the chromium layer is coated with gold, the gold preferably is applied in a weakly acid to neutral conventional gold bath an initial current density of about 3 A/dm$^2$ at a temperature of 50±5° C. for a period of 10 seconds.

When the chromium layer is coated with silver, the silver preferably is applied in a cyanide presilvering bath at an initial current density of about 2 A/dm$^2$ at a temperature of 20±3° C. for a period of 20 seconds.

When the chromium layer is coated with platinum, the platinum is preferably applied in an acid bath with an initial current density of about 3 A/dm$^2$ at a temperature of 50±5° C. for a period of 15 seconds.

When the chromium layer is coated with palladium, the palladium preferably is applied in a neutral bath at an initial current density of about 3 A/dm$^2$ at a temperature of 45±5° C. for a period of 15 seconds.

When the chromium layer is coated with rhodium, the rhodium preferably is applied in an acid bath at an initial current density of about 3 A/dm$^2$ at a temperature of 50±5° C. for a period of 25 seconds.

When the chromium layer is coated with ruthenium, the ruthenium preferably is applied in an acid bath at an initial current density of about 3 A/dm$^2$ at a temperature of 70±5° C. for a period of 20 seconds.

The applied layers are tempered in step (p) at a temperature of 500° C. to 1100° C. For gold, platinum, palladium, rhodium and ruthenium preferably for a period of 10 minutes, and at best at a temperature of 750° C. When the noble metal is silver, the tempering of step (p) is best performed at a temperature of about 950° C. for a period of 10 minutes.

It will be understood that the above description of the present invention is susceptible to various modifications, changes and adaptions, and the same are intended to be comprehended within the meaning and range of equivalents of the appended claims.

What is claimed is:

1. Molybdenum disc having a thickness of about 0.5 to several mm coated with a noble metal for use with a semiconductor, in which the noble metal is applied to the molybdenum in a layer thickness of 0.02$\mu$, via an intermediate layer of chromium having a layer thickness of 0.5 to 10.0$\mu$.

2. Molybdenum disc coated with a noble metal as defined in claim 1 wherein the noble metal is gold, silver, platinum, palladium, rhodium or ruthenium.

3. Molybdenum disc coated with a noble metal as defined in claim 1, wherein the chromium layer has a thickness of 1.5$\mu$.

* * * * *